US005711375A

United States Patent [19]

Ravi et al.

[11] Patent Number: 5,711,375

[45] Date of Patent: Jan. 27, 1998

[54] WELL STABILIZATION TOOLS AND METHODS

[75] Inventors: Krishna M. Ravi, Duncan; Robert M. Beirute, Tulsa; Alan B. Duell; Henry E. Rogers, both of Duncan; Dick A. Murray, Okmulgee; Earl D. Webb, Healdton, all of Okla.

[73] Assignee: Halliburton Company, Duncan, Okla.

[21] Appl. No.: 692,868

[22] Filed: Aug. 2, 1996

[51] Int. Cl.[6] ..... E21B 23/00

[52] U.S. Cl. ..... 166/285; 166/142; 175/215

[58] Field of Search ..... 166/128, 142, 166/169, 285, 283, 281; 175/215

[56] References Cited

U.S. PATENT DOCUMENTS

| | | | |
|---|---|---|---|
| 1,466,986 | 9/1923 | Burgher . | |
| 2,708,973 | 5/1955 | Twining | 166/22 |
| 2,776,111 | 1/1957 | Vance | 255/1 |
| 3,059,469 | 10/1962 | Caldwell | 166/285 X |
| 3,194,312 | 7/1965 | Thomas | 166/285 |
| 3,289,761 | 12/1966 | Smith et al. | 166/27 |
| 3,318,378 | 5/1967 | Coshow | 166/4 |
| 3,570,595 | 3/1971 | Berryman | 166/128 |
| 3,831,677 | 8/1974 | Mullins | 166/128 |
| 3,915,231 | 10/1975 | Mackie | 166/287 |
| 4,134,619 | 1/1979 | Bunnelle | 175/215 X |
| 4,275,788 | 6/1981 | Sweatman | 166/285 X |
| 4,415,206 | 11/1983 | Hodges | 175/215 X |
| 4,934,466 | 6/1990 | Paveliev et al. | 175/102 |
| 5,002,127 | 3/1991 | Dalrymple et al. | 166/285 X |
| 5,366,030 | 11/1994 | Pool, II et al. | 175/215 |

*Primary Examiner*—Frank Tsay

*Attorney, Agent, or Firm*—Craig W. Roddy; C. Clark Dougherty, Jr.

[57] ABSTRACT

The present invention relates to tools and methods for stabilizing incompetent or otherwise unstable subterranean zones or formations penetrated by a well bore during drilling. The methods basically comprise drilling the well bore through an unstable subterranean zone or formation when it is encountered, pumping a fluid through a well stabilization tool while moving the tool through the portion of the well bore in the unstable zone or formation whereby fluid jets formed by the well stabilization tool enlarge the diameter of the well bore by fluid jet erosion, pumping a hardenable cementitious material through the well stabilization tool while moving the tool through the enlarged portion of the well bore whereby the enlarged portion is filled with the hardenable cementitious material, allowing the cementitious material to harden and then drilling the well bore through the hardened cementitious material.

40 Claims, 5 Drawing Sheets

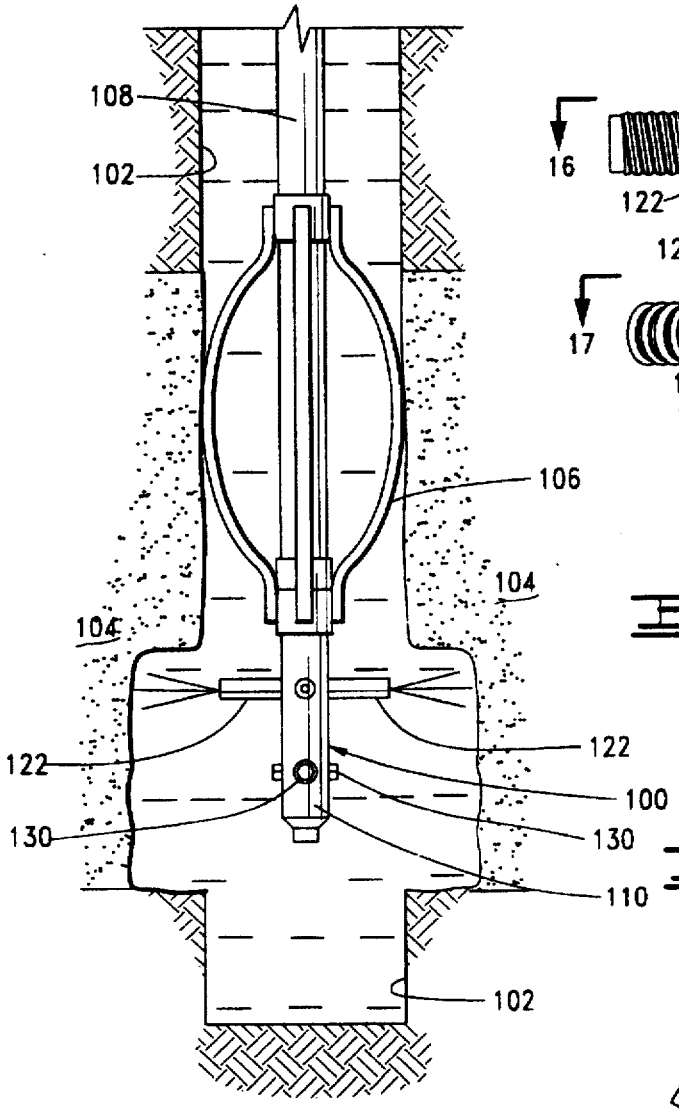
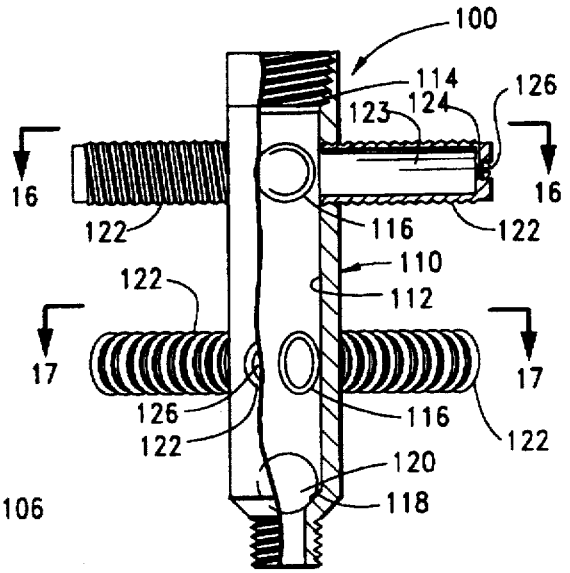
FIG. 15
FIG. 14
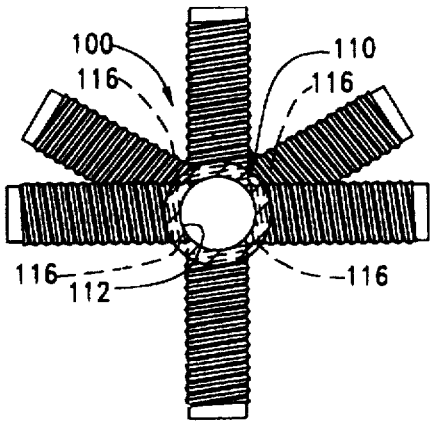
FIG. 16
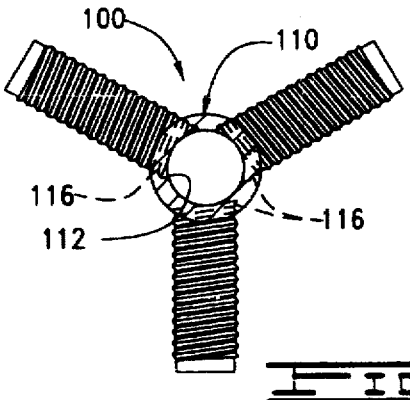
FIG. 17

WELL STABILIZATION TOOLS AND METHODS

BACKGROUND OF THE INVENTION

1. Field of the Invention

The present invention relates to tools and methods for enlarging and placing a cementitious material in a well bore which passes through an unstable subterranean zone or formation during drilling.

2. Description of the Prior Art

In the drilling of a well bore with a rotary drill bit, weight is applied to the drill string (a string of connected drill pipe sections) while the drill bit is rotated. A fluid, often referred to as drilling fluid or drilling mud, is circulated through the drill string, through the drill bit and upwardly to the surface through the annulus between the drill string and the walls of the well bore. The drilling fluid cools the drill bit, removes cuttings from the well bore and maintains hydrostatic pressure on pressurized subterranean formations.

During the drilling of a well bore, the well bore may penetrate and pass through incompetent or otherwise unstable subterranean zones or formations such as unconsolidated sands or shales. Such unstable zones or formations can have very high permeabilities whereby severe drilling fluid losses occur into the zones or formations. Also, the zones or formations can cave in, slough off or wash out due to the flow of drilling fluid through the well bore which causes the well bore to enlarge. This, in turn, can cause the drill string to become stuck as well as a variety of other severe problems. The zones or formations can also be charged with a fluid, e.g., water, which flows into the well bore making drilling difficult.

In order to solve the problems caused by an unstable subterranean zone or formation, the portion of the well bore passing through the zone or formation has heretofore been enlarged and filled with cementitious material. After the cementitious material has set, the well bore has been drilled through the cementitious material leaving a cementitious sheath in the well bore for preventing fluid influx, fluid losses, cave-ins, etc. While such techniques have been utilized successfully, they have heretofore required the use of many different tools, the necessity of making many trips in and out of the well bore, and a great deal of time and expense to complete.

Thus, there is a need for improved tools and methods for stabilizing unstable subterranean zones or formations penetrated by a well bore which do not require the use of many different tools, numerous drill string and/or work string trips, long delays and the like.

SUMMARY OF THE INVENTION

The present invention provides improved well stabilization tools and methods which meet the needs described above and obviate the shortcomings of the prior art.

The well stabilization tools and methods of the present invention can be used to stabilize an unstable zone or formation encountered in the drilling of a well bore without removing the drill string and drill bit from the well bore or only doing so a minimum of times. That is, one improved well stabilization tool of this invention can be connected in a drill string adjacent the drill bit before the well bore is drilled. The drilling of the well bore can then proceed in the normal manner until an unstable zone or formation is encountered. The well stabilization tool is then activated and used to enlarge the portion of the well bore which passes through the unstable zone or formation and to fill the enlarged well bore with a hardenable cementitious material. After the cementitious material has hardened, the well bore is drilled through the hardened material and normal drilling operations are resumed.

The well stabilization tool used as described above is basically comprised of a tubular housing having a fluid flow passage extending therethrough adapted to be connected in a drill string. The housing includes one or more outwardly extending enlarged portions formed thereon whereby the outer surfaces of the enlarged portions are positioned in close proximity to the walls of the well bore drilled with the drill string and drill bit and having one or more lateral fluid jet forming ports extending from the fluid flow passage through the enlarged portions of the housing to the exterior thereof. A valve sleeve is releasably and slidably disposed within the fluid flow passage of the housing which is movable between a first position whereby the fluid jet forming ports are closed by the valve sleeve and fluid pumped through the drill string is free to flow through the fluid flow passage of the housing by way of the interior of the valve sleeve and a second position whereby the fluid jet forming ports are opened.

The tool is activated by an activator plug which is flowed through the drill string into the housing where it releasably engages and plugs the valve sleeve causing it to move from the first position to the second position whereby fluid pumped through the drill string is forced through the fluid jet forming ports of the tool. When the activator plug is retrieved, the valve sleeve is pulled back to the first position so that fluid again flows through the tool.

The methods of using the above described tool basically comprise the steps of placing the tool in a drill string near the drill bit, drilling a well bore with the valve sleeve of the tool in the first position whereby fluid flows through the tool and through the drill bit until the well bore has been drilled through an unstable subterranean zone or formation. The tool is then activated by means of the above mentioned activator plug and the valve sleeve is moved to its second position whereby fluid flows through the jet forming ports of the tool. Fluid is pumped through the drill string and through the tool at a rate while moving the tool through the portion of the well bore in the unstable zone or formation whereby the diameter of the well bore is enlarged by fluid jet erosion. A hardenable cementitious material is then pumped through the drill string and through the jet forming ports of the tool at a rate while moving the tool through the enlarged portion of the well bore whereby the enlarged portion is filled with the cementitious material. While the cementitious material is allowed to harden, the activator plug is retrieved which moves the valve sleeve back to its first position after which the well bore is drilled through the hardened material and normal drilling operations are resumed.

An alternate well stabilization tool of this invention for enlarging and placing a cementitious material in an unstable subterranean zone or formation passed through by a well bore requires only a minimum number of trips in and out of the well bore. That is, after a well bore penetrates and passes through an unstable zone or formation, the drill string is removed from the well bore, the drill bit is replaced with the well stabilization tool and the tool and drill string are placed back in the well bore. The tool is used to enlarge and place a hardenable cementitious material in the unstable zone or formation whereupon the drill string is removed from the well bore and the well stabilization tool is replaced with the drill bit. After the drill string and drill bit have been placed back in the well bore, the well bore is drilled through the hardened cementitious material and normal drilling operations are resumed.

The well stabilization tool used as described above is basically comprised of a tubular housing having a longitudinal fluid flow passage extending therethrough and having a plurality of lateral threaded openings extending from the fluid flow passage to the exterior of the housing. The housing includes a seat for receiving an activated plug and a plurality of tubular threaded arm members are threadedly connected within the threaded openings in the housing. The threaded arm members have fluid flow passages extending therethrough and have fluid jet forming ports communicating with the passages at their exterior ends. The arm members are of lengths such that the fluid jet forming ports at the exterior ends thereof are positioned in close proximity to the walls of the well bore. A further feature of this tool is that the tool can be made up using different sizes of arm members to conform the tool to varying well bore sizes.

It is, therefore, a general object of the present invention to provide improved well stabilization tools and methods.

Other and further objects, features and advantages of the present invention will be readily apparent to those skilled in the art upon a reading of the description of preferred embodiments which follows when taken in conjunction with the accompanying drawings.

BRIEF DESCRIPTION OF THE DRAWINGS

FIG. 6 is a side cross-sectional view of the valve sleeve of the tool of FIG. 1.

FIG. 14 is a schematic illustration of an alternate well stabilization tool of this invention in a well bore which passes through an unstable zone or formation.

FIG. 15 is a side partially cross-sectional view of the tool illustrated in FIG. 14 having additional arm members connected thereto.

FIG. 16 is a cross-sectional view taken along line 16—16 of FIG. 15.

FIG. 17 is a cross-sectional view taken along line 17—17 of FIG. 15.

DESCRIPTION OF PREFERRED EMBODIMENTS

Figure 1:
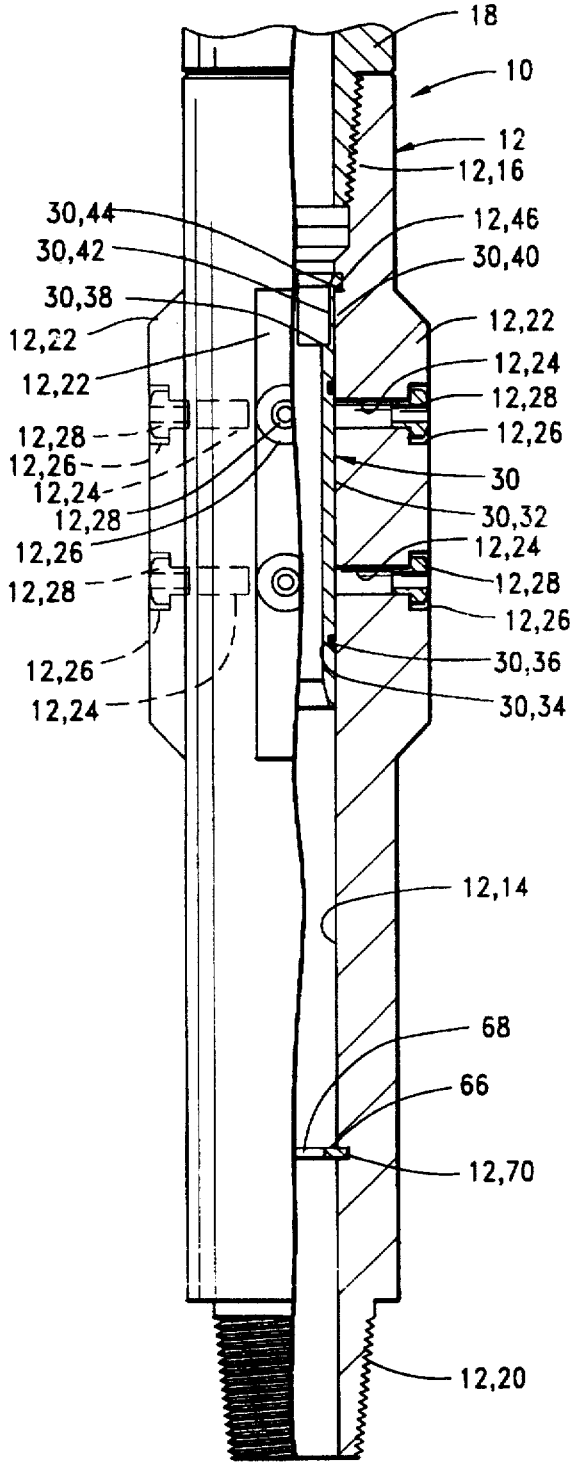
FIG. 1 is a side partially sectional view of a well stabilization tool of the present invention.

Referring now to the drawings and particularly FIGS. 1–6, an embodiment of the well stabilization tool of the present invention is illustrated and generally designated by the numeral 10. The tool 10 is comprised of a tubular housing 12 having a longitudinal fluid flow passage 14 extending therethrough. The housing 12 includes a conventional female threaded connection 16 at the upper end thereof for threaded connection to a drill string 18. As is well understood by those skilled in the art, the drill string 18 is made up of a plurality of drill pipe sections threadedly connected end to end. A complimentary male threaded connection 20 is provided at the lower end of the housing 12 for connecting the tool 10 to a drill pipe section, a drill collar or the drill bit (not shown).

The housing 12 includes four outwardly extending enlarged rib portions 22 which are positioned in close proximity to the walls of a well bore drilled with the drill string 18 and a drill bit (not shown) connected below the tool 10. As will be understood by those skilled in the art, the housing 12 can include a single cylindrical enlarged portion or two or more enlarged rib portions 22 as desired. The housing 12 further includes a plurality of fluid jet forming passages or ports 24 formed therein extending from the fluid flow passage 14 of the housing 12 through the enlarged rib portions 22 thereof to the exterior of the housing 12. Preferably, the lateral ports 24 are arranged in two groups of three or four equally spaced ports 24 (two groups of four ports 24 are illustrated in the drawings). Also, the ports 24 preferably intersect enlarged counter bores 26 in the housing 12 adjacent the exterior thereof and include fluid jet forming nozzles 28 threadedly connected therein. In an alternative embodiment (not shown), the nozzles 28 may extend through the full length of the lateral ports 24 to the fluid passage 14 for preventing erosion of the housing 12 and to increase the fluid jetting efficiency therefrom. As will be described further hereinbelow, some of the ports 24 can include plugs instead of nozzles 28, and the sizes of the flow passages through the nozzles 28 can be varied as required to produce the desired number and velocities of the fluid jets issuing from the tool 10.

Figure 2:
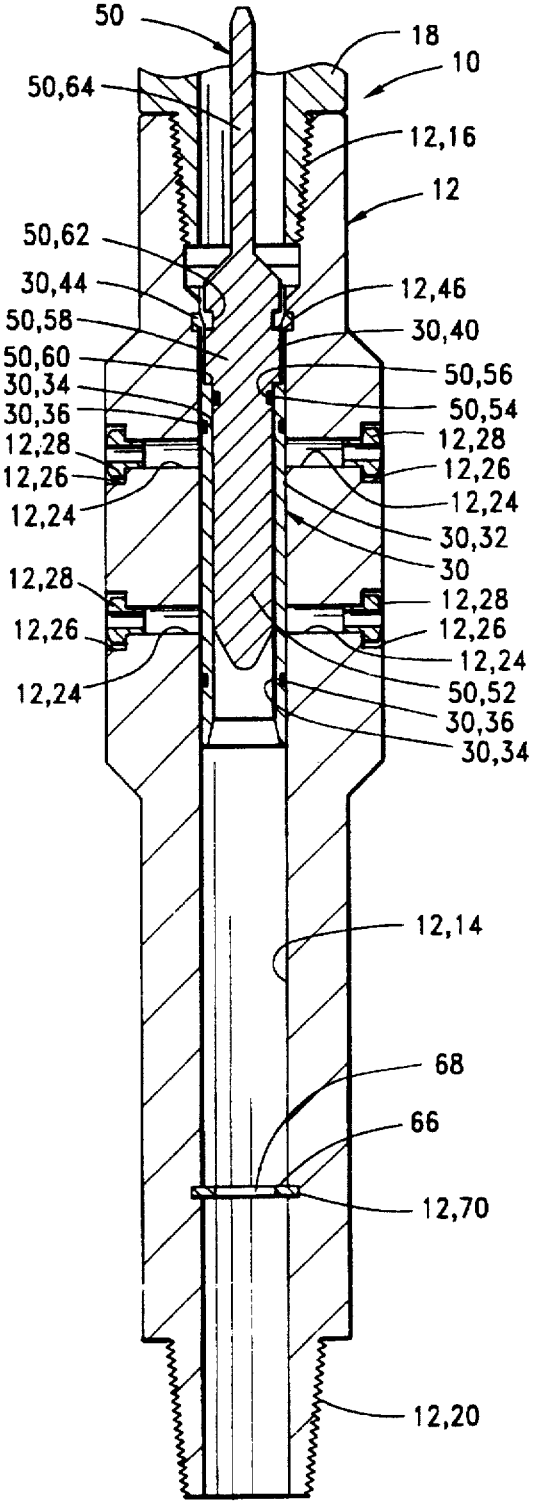
FIG. 2 is a side cross-sectional view of the tool of FIG. 1 after an activator plug has engaged a valve sleeve in the tool.
Figure 5:
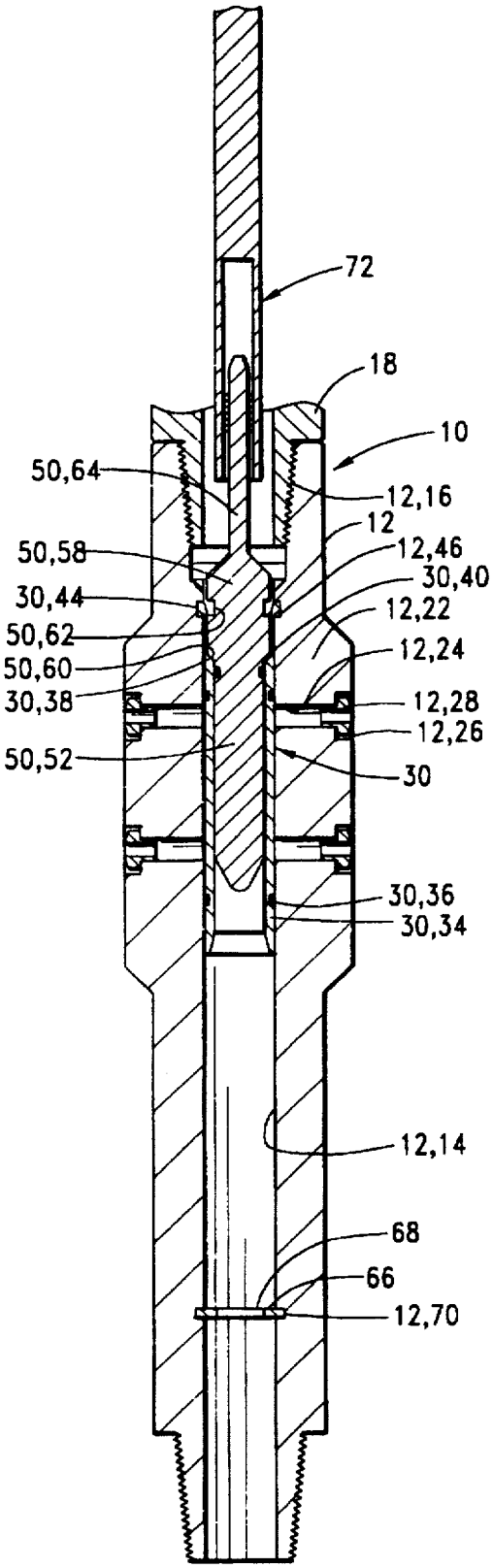
FIG. 5 is a cross-sectional view of the tool of FIG. 1 after the activator plug and valve sleeve have been moved upwardly within the tool as the activator plug is being retrieved therefrom.

The tool 10 includes a valve sleeve 30 releasably and slidably disposed within the fluid flow passage 14 of the housing 12. The valve sleeve 30 includes an elongated cylindrical body portion 32 having a pair of longitudinally spaced grooves 34 formed in the exterior surface thereof with conventional O-ring seals 36 disposed therein. As shown in FIGS. 1, 2 and 5, the grooves 34 in the valve sleeve 30 are spaced a distance apart whereby the O-ring seals bracket the lateral fluid jet forming ports 24 when the valve sleeve is in its first position as shown in FIGS. 1, 2 and 5.

Figure 7:
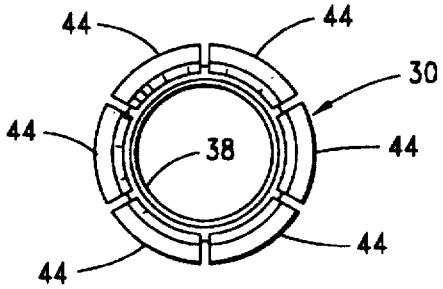
FIG. 7 is a top view of the valve sleeve of FIG. 6.
Figure 5:
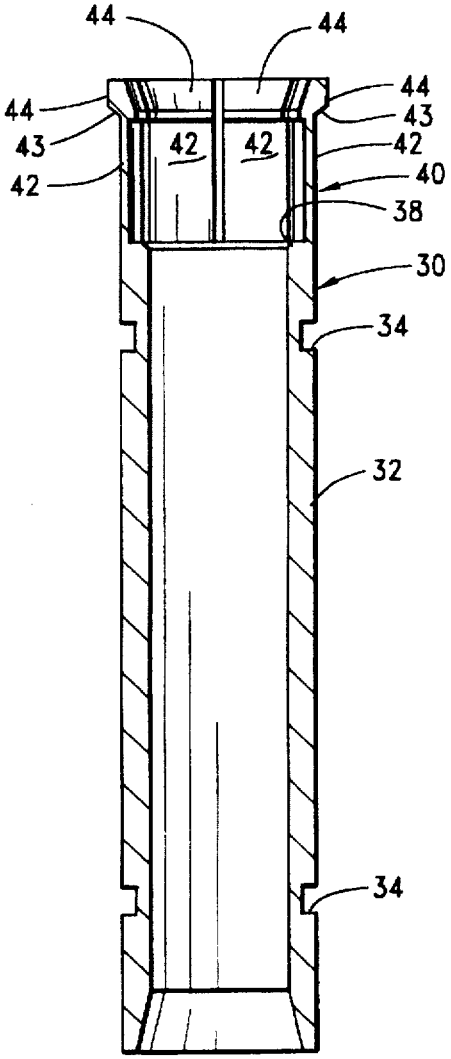

As shown best in FIGS. 6 and 7, the upper end portion of the valve sleeve 30 includes an internal activator plug receiving seat 38 and a collet 40 comprised of a plurality of collet fingers 42 extending upwardly from the receiving seat 38. Each of the collet fingers 42 of the collet 40 have collet heads 44 at the upper ends thereof. The collet heads 44 protrude radially outwardly and the external surfaces of the collet fingers 42 below the heads 44 are recessed whereby the lower surfaces 43 of the collet heads 44 are inclined (as shown in FIG. 6). Alternatively, the collet heads 44 may include additional collet fingers (not shown) extending upwardly therefrom, wherein the collet fingers (not shown) are attached to one another at an end distant from the collet heads 44. When the valve sleeve 30 is in its first position within the housing 12 as illustrated in FIGS. 1, 2 and 5, the collet heads 44 of the collet 40 extend within a complimentary groove 46 in the housing 12 whereby the valve sleeve 30 is releasably retained in the first position.

When it is desired to activate the tool 10, i.e., move the valve sleeve 30 to a second position within the flow passage 14 of the housing 12 whereby the fluid jet forming ports are opened, an activator plug 50 is flowed through the drill string 18 and housing 12 into releasable engagement with the valve sleeve 30 as illustrated in FIG. 2.

The activator plug 50 includes an elongated nose portion 52 which is of an external size slightly smaller than the internal diameter of the valve sleeve 30. The nose portion 52 includes an O-ring groove 54 with an O-ring 56 disposed therein for providing a seal between the external surface of the nose portion 52 and the internal surface of the valve sleeve 30. Immediately above the nose portion 52 of the activator plug 50 is an enlarged portion 58 which forms an annular shoulder or seat 60 on the activator plug 50 complimentary to the annular seat 38 within the valve sleeve 30. An annular groove 62 is formed in the enlarged portion 58 of the activator plug 50 which is positioned to receive the collet heads 44 of the collet 40 as will be described hereinbelow. Finally, the activator plug 50 includes a reduced diameter upwardly extending fishing neck 64 connected to the enlarged portion 58.

Figure 3:
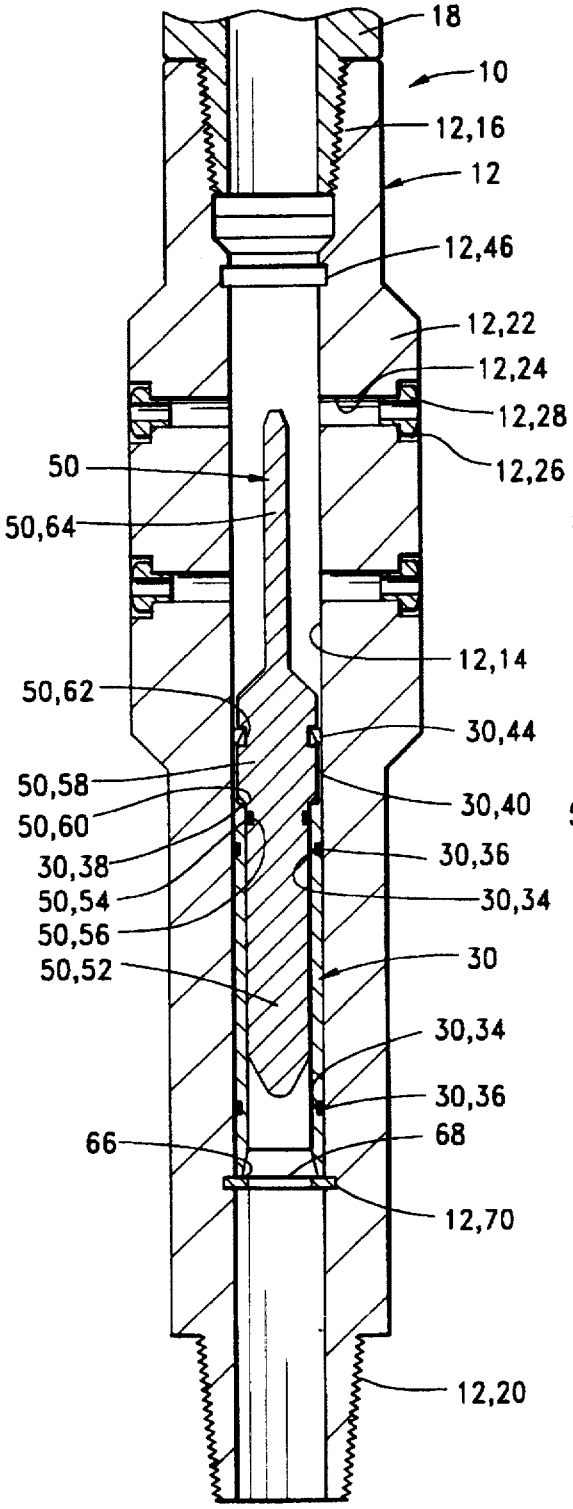
FIG. 3 is a side cross-sectional view of the tool of FIG. 1 after the activator plug and valve sleeve have been moved downwardly in the tool by fluid pressure.

When the activator plug 50 is flowed by drilling fluid pumped through the drill string 18 and housing 12 of the tool 10 into engagement with the valve sleeve 30 as illustrated in FIG. 2, the seat 60 of the activator plug 50 lands on the seat 38 of the valve sleeve 30 thereby plugging the interior of the valve sleeve 30 and moving it to a second position as shown in FIG. 3. That is, the activator plug 50 seals the interior of the valve sleeve 30 whereby fluid pressure produced by drilling fluid pumped through the drill string and into the housing 12 forces the activator plug 50 and valve sleeve 30 to move downwardly in the passage 14 of the housing 12. As the activator plug 50 and valve sleeve 30 move downwardly, the collet heads 44 of the collet 40 are pulled out of the annular groove 46 in the housing 12 whereby the valve sleeve 30 is released from its first position. Simultaneously, the collet heads 44 are deformed into the annular groove 62 in the enlarged portion 58 of the activator plug 50 as illustrated in FIGS. 3 and 4 whereby the valve sleeve 30 is releasably engaged by the activator plug 50.

As shown in FIG. 3, the downward movement of the activator plug 50 and valve sleeve 30 is terminated when the valve sleeve reaches its second position by an annular shoulder 66 extending into the fluid flow passage 14 of the housing 12. In the form illustrated in the drawings, the annular shoulder 66 is formed by a snap ring 68 disposed within a groove 70 in the housing 12. As will be understood, when the valve sleeve 30 is in its second position shown in FIG. 3, fluid pumped through the drill string and into the housing 12 of the tool 10 flows through the fluid jet forming ports 24 of the housing 12.

Figure 4:
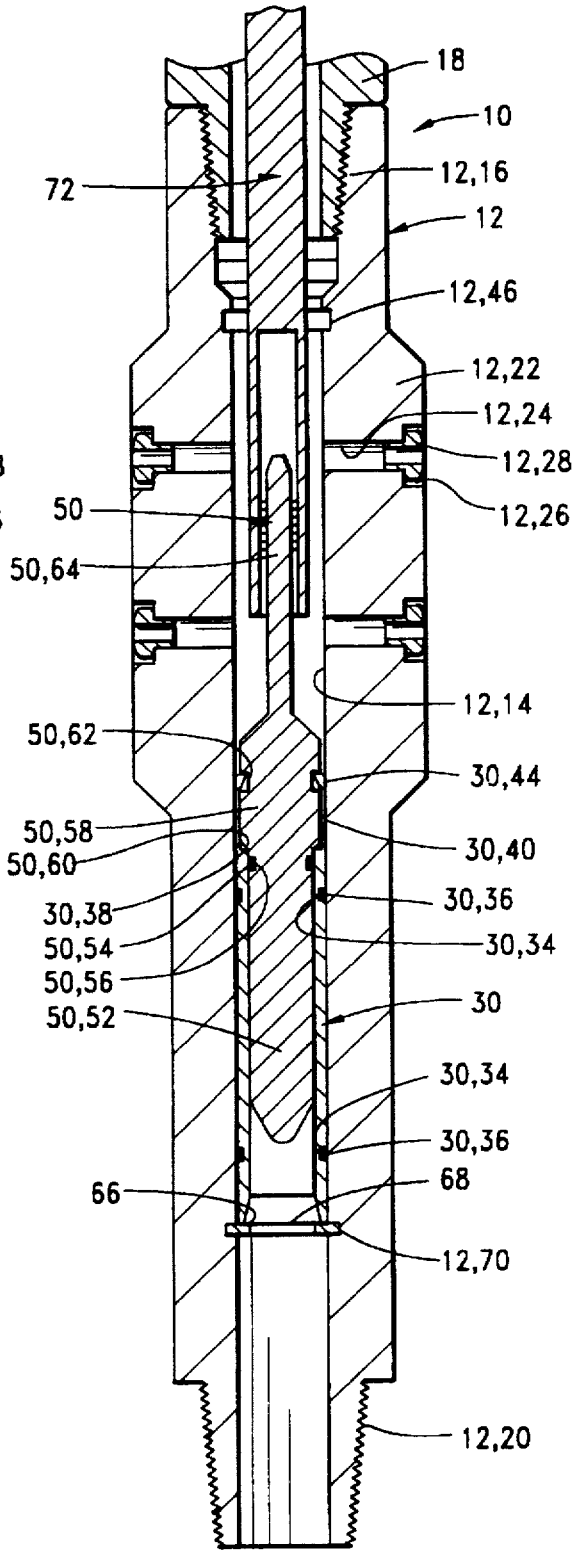
FIG. 4 is a side cross-sectional view of the tool of FIG. 1 after a fishing tool has engaged the fishing neck of the activator plug within the tool.

When it is desired to move the valve sleeve 30 of the tool 10 back to its first position and remove the activator plug 50 from the interior of the housing 12 of the tool 10 whereby normal well bore drilling can be resumed, a fishing tool 72 is lowered through the drill string 18 by means of a wire line, a slick line or a working string into the flow passage 14 of the housing 12 whereby the fishing neck 64 of the activator plug 50 is engaged by the fishing tool 72 as shown in FIG. 4. Thereafter, the fishing tool 72 and activator plug 50 are raised whereby they are moved upwardly within the housing 12. As the activator plug is moved upwardly, the valve sleeve 30 is pulled with it since the collet heads 44 of the collet 40 of the valve sleeve 30 extend into the annular groove 62 of the activator plug 50 and are engaged thereby. When the activator plug 50 and the valve sleeve 30 are pulled upwardly to the point where the valve sleeve 30 reaches its first position, the collet heads 44 of the valve sleeve 30 spring back into the annular groove 46 in the housing 12 and out of the annular groove 62 in the activator plug 50. This releases the activator plug 50 from the valve sleeve 30 whereby the continued upward movement of the fishing tool 72 and activator plug 50 removes the activator plug 50 from the tool 10. The fishing tool 72 and activator plug 50 are then lifted to the surface and removed from the drill string.

Figure 8:
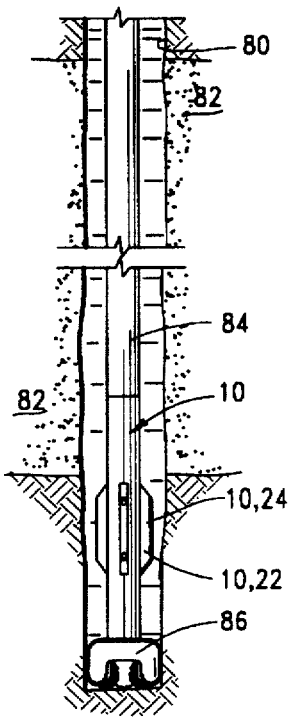
FIGS. 8–13 are sequential schematic illustrations of a well bore drilled through an unstable zone or formation and the stabilization of the well bore using the tool of FIG. 1 and the method of the present invention.

Referring now to FIGS. 8–13, the various steps involved in stabilizing an unstable subterranean zone or formation passed through by a well bore during its drilling using the well stabilization tool 10 are schematically illustrated. Referring specifically to FIG. 8, a well bore 80 which has been drilled through an unstable subterranean zone or formation 82 with a drill string 84 having the tool 10 and a drill bit 86 connected thereto is illustrated. As will be understood, the well stabilization tool 10 is placed in the drill string prior to the commencement of drilling with the valve sleeve 30 in its first position whereby drilling fluid pumped into the drill string 84 during drilling flows through the flow passage 14 of the housing 12 of the tool 10 and through the interior of the valve sleeve 30, through the drill bit 86 and upwardly through the annulus between the drill string 84 and well bore 80. When the well bore 80 has been drilled to a depth whereby it has passed through the unstable zone or formation 82, the drilling of the well bore is stopped and the activator plug 50 is placed into the drill string 84 at the surface. The activator plug 50 is caused to flow by pumped drilling fluid through the drill string 84 and into the housing 12 of the tool 10 where it engages the valve sleeve 30 of the tool 10, moves it from its first position to its second position and opens the lateral fluid jet forming ports 24.

Figure 9:
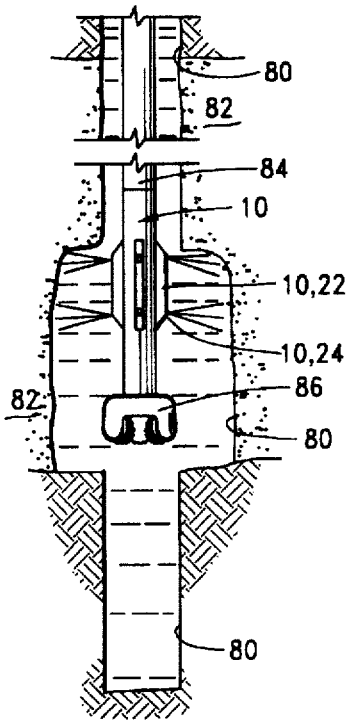
Figure 10:
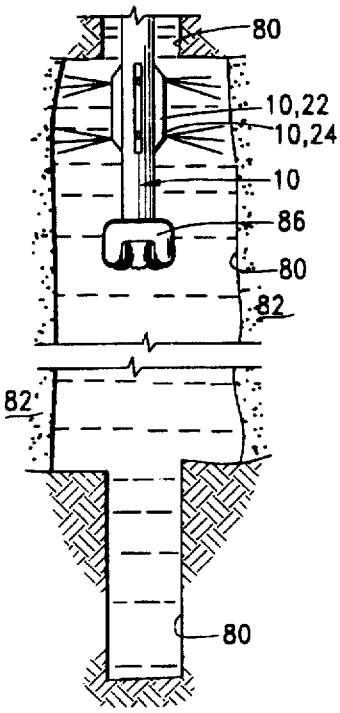

Referring now to FIG. 9, after the fluid jet forming ports 24 are opened, drilling fluid is pumped through the drill string and through the fluid jet forming ports 24 of the tool 10 at a rate while moving the tool 10 through the portion of the well bore 80 in the unstable zone or formation 82 whereby the diameter of the well bore 80 is enlarged by fluid jet erosion. That is, the drilling fluid jets issuing from the ports 24 of the tool 10 impinge on the walls of the well bore 80 in the unstable zone or formation 82 causing the well bore 80 to be eroded and enlarged as illustrated in FIGS. 9 and 10.

Figure 11:
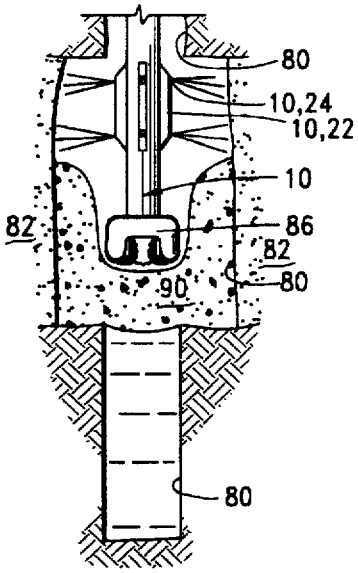
Figure 12:
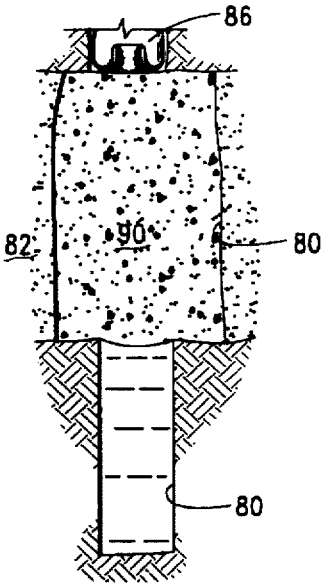
Figure 13:
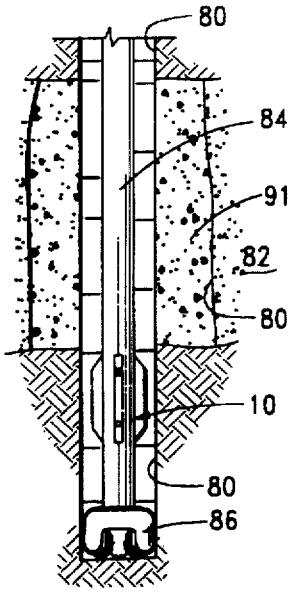

Referring now to FIG. 11, once the portion of the well bore 80 passing through the unstable zone or formation 82 has been enlarged, a hardenable cementitious material is pumped through the drill string 84 and through the jet forming ports 24 of the tool 10 at a rate while moving the tool 10 through the enlarged portion of the well bore 80 whereby the enlarged portion of the well bore is filled with a quantity 90 of cementitious material as shown in FIGS. 11 and 12. As shown in FIG. 12, when the enlarged portion of the well bore 80 has been completely filled with the cementitious material, the drill string 84, the tool 10 and drill bit 86 are moved to a position in the well bore 80 above the enlarged portion containing the cementitious material and the cementitious material is allowed to harden. While the cementitious material is hardening, the activator plug 50 is removed from the tool 10 and drill string 84 which closes the ports 24 of the tool 10. Thereafter, the well bore 80 is redrilled through the hardened cementitious material as shown in FIG. 13 and normal drilling operations are resumed. The cement sheath 91 which remains in the unstable zone or formation stabilizes the well bore passing therethrough and prevents such problems as excessive fluid loss, cave ins, wash outs, etc.

As will be understood by those skilled in the art, a variety of hardenable cementitious materials can be utilized in accordance with this invention for stabilizing an unstable subterranean zone or formation. For example, hydraulic cementitious materials which form hard impermeable masses in the presence of water can be utilized such as Portland cement, high alumina cement, slag and/or fly ash (ASTM Class F fly ash) and lime, fly ash which includes free lime (ASTM Class C fly ash), condensed silica fume with lime, gypsum cement (calcium sulfate hemihydrate) and mixtures of the foregoing materials. Hardenable cementitious materials which are not hydraulic such as hardenable resins and the like can also be used. The particular cementitious material used depends upon a variety of factors relating to the particular unstable zone or formation to be stabilized. Essentially, any pumpable cementitious material that will harden after being placed in a subterranean zone at the temperature, pressure and other conditions in the zone to provide stability thereto after the well bore has been drilled through the material can be utilized.

Thus, the method of stabilizing an unstable subterranean zone or formation passed through by a well bore during the drilling of the well bore with a drill bit connected to a drill string using the tool 10 basically comprises the following steps:

(1) placing the well stabilization tool 10 in the drill string near the drill bit, the tool having a longitudinal fluid flow passage therethrough, having one or more lateral fluid jet forming ports therein and having an internal valve which can be selectively moved between a first position whereby fluid pumped into the drill string is flowed through the fluid flow passage of the tool and through the drill bit and a second position whereby the fluid is flowed through the lateral fluid jet forming ports of the tool;

(2) drilling the well bore with the valve of the well stabilization tool in its first position until the well bore has been drilled through the unstable subterranean zone or formation;

(3) moving the valve of the tool from its first position to its second position and pumping fluid through the jet forming ports at a rate while moving the tool through the portion of the well bore in the unstable zone or formation whereby the diameter of the well bore is enlarged by fluid jet erosion;

(4) pumping a hardenable cementitious material through the drill string and through the jet forming ports of the tool at a rate while moving the tool through the enlarged portion of the well bore in the unstable zone or formation whereby the enlarged portion of the well bore is filled with the cementitious material;

(5) moving the valve of the tool back to its first position while the cementitious material is allowed to harden; and then (6) drilling the well bore through the hardened cementitious material thereby forming a hardened cementitious material sheath in the unstable zone or formation which stabilizes the well bore.

Another well stabilization tool of this invention for enlarging and placing a hardenable cementitious material in an unstable subterranean zone or formation passed through by a well bore is illustrated in FIGS. 14–17 and is generally designated by the numeral 100. The well stabilization tool 100 does not include a valve and is adapted to be connected to a drill string in place of the drill bit. That is, when a well bore has been drilled through an unstable subterranean zone or formation utilizing a drill bit connected to a drill string, the drill string and drill bit are removed from the well bore and the drill bit is replaced with the tool 100. In addition, if the drill string does not already include a drill string centralizer, such a centralizer is placed in the drill string adjacent to or near the well stabilization tool 100. As will be described further hereinbelow, the well stabilization tool 100 is utilized to enlarge the portion of the well bore passing through the unstable zone or formation and to fill the enlarged portion of the well bore with a cementitious material. While the cementitious material is setting, the drill string having the well stabilization tool connected thereto is pulled from the well bore, the well stabilization tool and drill string centralizer (if not left in the drill string) are removed from the drill string, the drill bit is replaced on the drill string and the drill string and drill bit are placed in the well bore. The drill string and drill bit are used to drill the well bore through the set cementitious material leaving a cementitious sheath in the unstable zone or formation which stabilizes the zone or formation. Thereafter, normal drilling operations are resumed.

Referring now to FIG. 14, a well bore 102 drilled through an unstable zone or formation 104 is illustrated. The drill string has previously been removed from the well bore and the drill bit replaced with a conventional drill string centralizer 106 and the well stabilization tool 100. Drill string centralizers are well known to those skilled in the art and function to maintain the drill string and tools connected thereto in a central position within the well bore. For example, the drill string centralizer illustrated in FIG. 14 is a typical bow spring type of centralizer which contacts the walls of the well bore and expands or compresses as required. The centralizer 106 can be a separate tool or an integral part of the well stabilization tool 100. The drill string 108 including the centralizer 106 and tool 100 are placed in the well bore 102 and lowered to the portion of the well bore 102 within the unstable zone or formation 104. The tool 100 is then utilized to enlarge the portion of the well bore 102 within the zone or formation 104 as shown in FIG. 14, and subsequently fill the enlarged portion with a cementitious material in the same manner as described above in connection with the well stabilization tool 10. As mentioned above, the centralizer 106 and the well stabilization tool 100 are removed from the drill string 108 while the cementitious material sets, and the drill string and drill bit are placed back in the well bore, used to drill the well bore through the set cementitious material and to continue drilling the well bore below the unstable zone or formation.

Referring now to FIGS. 15–17, the well stabilization tool 100 is illustrated in detail. The tool 100 basically comprises a tubular housing 110 having a longitudinal fluid flow passage 112 extending therethrough. A threaded connection 114 is provided at the upper end of the housing 112 for connecting the tool 100 to the drill string, and a plurality of lateral threaded openings 116 extending from the fluid flow passage 112 to the exterior of the housing 110 are formed in the housing 110. An annular seating surface 118 is provided within the fluid flow passage 112 of the housing 110 below the lateral threaded openings 116 therein for receiving an activator plug 120 (as shown in FIG. 15). As will be understood, the activator plug 120, which can be in the form of a ball, is flowed by drilling fluid to within the flow passage 112 of the housing 110 of the tool 100 and lands on the seat 118. The activator plug 120 plugs the passage 112 whereby drilling fluid is forced to flow through the lateral threaded openings 116 of the tool 100.

A plurality of tubular threaded arm members 122 are threadedly connected within the threaded openings 116 in the housing 110. Each of the threaded arm members 122 includes a flow passage 123 therethrough and a fluid jet forming port 124 formed in the end thereof. Like the previously described well stabilization tool 10, the fluid jet forming ports 124 of the tubular threaded arm members 122 can include nozzles 126 threadedly connected thereto which can be varied in size to vary the velocities and other aspects of the fluid jets formed.

Prior to using the well stabilization tool 100 for enlarging and placing a hardenable cementitious material in a well bore passing through an unstable zone or formation, tubular threaded arm members 122 are threadedly connected in the lateral threaded openings 116 of the tool 10. The tubular threaded arm members 122 have lengths such that the fluid jet forming ports 24 at the exterior ends of the threaded arm members 122 are positioned in close proximity to the walls of the well bore in which the tool is to be used. To accomplish this, various lengths of tubular threaded arm members 122 can be made available for installation in the housing 110, or arm members 122 which are too long can be shortened by cutting portions therefrom at the interior ends thereof.

As shown in FIG. 14, the tool 100 can include a number of tubular threaded arm members 122 less than the number of lateral threaded openings 116 in the housing 110. The openings which do not have tubular threaded arm members 122 connected thereto can be plugged by threaded plugs 130. The well stabilization tool 100 preferably includes seven lateral threaded openings 116 therein with four of the openings 116 being equally spaced around the periphery of the housing 110 at a first upper position on the housing 110 and three of the threaded openings 116 being equally spaced around the periphery of the housing 110 at a second lower position on the housing 110 as shown in FIGS. 15–17. The tool 100 can include seven tubular threaded arm members 122 as illustrated in FIGS. 15–17, or less than seven threaded arm members 122 can be utilized as mentioned above. Preferably, when less than seven arm members 122 are utilized, they are either two, three or four in number. When two or four threaded arm members 122 are used they are connected within two opposite or all four of the four equally spaced threaded openings 116 in the upper position on the housing 110 with two threaded openings in the upper position and/or the threaded openings 116 in the lower position being plugged. When three threaded arm members 122 are used they are threadedly connected within the three threaded openings 116 in the lower position on the housing 110 with the threaded openings 116 in the upper position being plugged.

Thus, the method of stabilizing an unstable subterranean zone or formation passed through by a well bore during the drilling of the well bore with a rotary drill bit connected to a drill string utilizing the well stabilization tool 100 basically comprises the following steps:

(1) removing the drill string and drill bit from the well bore;

(2) connecting a drill string centralizer and/or a well stabilization tool 100 to the drill string in place of the drill bit, the well stabilization tool comprising, a tubular housing having a longitudinal fluid flow passage extending therethrough, having a threaded drill string connection at the upper end thereof, having a plurality of lateral threaded openings extending from the fluid flow passage to the exterior of the housing and having an annular seat extending into the flow passage below the lateral threaded openings for receiving an activator plug, and a plurality of tubular threaded arm members threadedly connected within the threaded openings in the housing having fluid flow passages therethrough and having fluid jet forming ports communicated with the fluid flow passages at the exterior ends thereof, the arm members being of lengths such that the fluid jet forming ports at the exterior ends thereof are positioned in close proximity to the walls of the well bore when the tool is connected to the drill string and placed in the well bore;

(3) placing the drill string, centralizer and well stabilization tool in the well bore with the tool positioned within the portion of the well bore in the unstable zone or formation;

(4) flowing an activator plug with fluid pumped through the drill string into the housing of the tool whereby the activator plug lands on the annular shoulder in the housing and the fluid is caused to flow through the tubular arm members and the fluid jet forming ports of the tool;

(5) pumping fluid through the jet forming ports at a rate while moving the tool through the portion of the well bore in the unstable zone or formation whereby the diameter of that portion of the well bore is enlarged by fluid jet erosion;

(6) pumping a cementitious material through the drill string and through the fluid jet forming ports at a rate while moving the tool through the enlarged portion of the well bore in the unstable zone or formation whereby the enlarged portion of the well bore is filled with the cementitious material;

(7) removing the drill string and well stabilization tool from the well bore while the cementitious material is allowed to set;

(8) reconnecting a drill bit to the drill string and placing the drill string and drill bit in the well bore; and (9) drilling the well bore through the set cementitious material to thereby form a cementitious sheath in the well bore which stabilizes the well bore passing through the unstable zone or formation and resuming normal well bore drilling operations.

Thus, the well stabilization tools and methods of the present invention are well adapted to carry out the objects and attain the ends and advantages mentioned as well as those which are inherent therein. While numerous changes to the tools and methods can be made by those skilled in the art, such changes are encompassed within the spirit of this invention as defined by the appended claims.

What is claimed is:

1. A well stabilization tool for enlarging and placing a hardenable cementitious material in an unstable subterranean zone or formation passed through by a well bore comprising:

a housing adapted for connection with a drill string, said housing having a fluid flow passage in communication with the drill string;

wherein the tool includes one or more ports in fluid communication with said fluid flow passage;

means for positioning said one or more ports in close proximity to the walls of the well bore when the tool is connected to the drill string and placed in the well bore; and means for causing fluid pumped through the drill string to be forced through said one or more ports.

2. A method of stabilizing an unstable subterranean zone or formation passed through by a well bore comprising the steps of:

(a) attaching a well stabilization tool to a drill string, said tool comprising:

a housing having a fluid flow passage in communication with the drill string;

wherein said tool includes one or more ports in fluid communication with said fluid flow passage whereby fluid may be pumped into the drill string and through said one or more ports;

(b) placing said tool within the portion of the well bore in the unstable zone or formation;

(c) pumping fluid through said one or more ports and into the portion of the well bore in the unstable zone or formation whereby the diameter of the well bore is enlarged by fluid jet erosion;

(d) pumping a hardenable cementitious material through said one or more ports and into the enlarged portion of the well bore in the unstable zone or formation whereby the enlarged portion of the well bore is filled with said hardenable cementitious material;

(e) allowing said cementitious material to harden within the enlarged portion of the well bore; and (f) drilling the well bore through said hardened cementitious material.

3. The method of claim 2 further comprising the step of flowing an activator plug with drilling fluid through the drill string wherein said plug causes fluid to be flowed through said one or more ports.

4. A well stabilization tool for enlarging and placing a hardenable cementitious material in an unstable subterranean zone or formation passed through by a well bore adapted to be connected in a drill string having a drill bit at the end thereof comprising:

a tubular housing having a longitudinal fluid flow passage extending therethrough, having one or more outwardly extending enlarged portions formed thereon whereby the outer surfaces of said enlarged portions are positioned in close proximity to the walls of the well bore drilled with the drill string and drill bit and having one or more lateral fluid jet forming ports extending from said fluid flow passage through said enlarged portions of said housing to the exterior thereof; and a valve sleeve releasably and slidably disposed within said fluid flow passage of said housing and being movable between a first position whereby said fluid jet forming ports are closed by said valve sleeve and fluid pumped through the drill string is free to flow through said housing by way of the interior of said valve sleeve and a second position whereby said fluid jet forming ports are opened;

said valve sleeve being moved from said first position to said second position when releasably engaged and plugged by an activator plug flowed through the drill string into said housing thereby causing fluid pumped through the drill string to be forced through said fluid jet forming ports, and said valve sleeve being pulled back to said first position from said second position when said activator plug is retrieved from said housing.

5. The well stabilization tool of claim 4 wherein said valve sleeve is prevented from moving past said second position by an annular shoulder extending into said fluid flow passage of said housing.

6. The well stabilization tool of claim 4 wherein said valve sleeve is releasably retained in said first position by a radially outwardly extending collet connected to said valve sleeve which engages a groove in said housing.

7. The well stabilization tool of claim 6 wherein said valve sleeve is releasably engaged with said activator plug by said collet which is forced inwardly by the surfaces of said housing fluid flow passage into engagement with a groove in said activator plug when said valve sleeve is moved from said first position to said second position by said activator plug.

8. The well stabilization tool of claim 4 wherein said enlarged portions of said tubular housing are comprised of two or more outwardly extending ribs formed thereon.

9. The well stabilization tool of claim 4 wherein said one or more lateral fluid jet forming ports are positioned radially in said housing.

10. A method of stabilizing an unstable subterranean zone or formation passed through by a well bore during the drilling of the well bore with a drill bit connected to a drill string comprising the steps of:

(a) placing a well stabilization tool in the drill string near the drill bit, said tool having a longitudinal fluid flow passage therethrough, having one or more lateral fluid jet forming ports therein and having an internal valve which can be selectively moved between a first position whereby fluid pumped into the drill string is flowed through said fluid flow passage of said tool and through the drill bit and a second position whereby said fluid is flowed through said lateral fluid jet forming ports of said tool;

(b) drilling the well bore with said valve of said tool in said first position until the well bore has been drilled through the unstable subterranean zone or formation;

(c) moving said valve of said tool from said first position to said second position and pumping fluid through said jet forming ports at a rate while moving said tool through the portion of the well bore in the unstable zone or formation whereby the diameter of the well bore is enlarged by fluid jet erosion;

(d) pumping a hardenable cementitious material through the drill string and through said jet forming ports of said tool at a rate while moving said tool through the enlarged portion of the well bore in the unstable zone or formation whereby the enlarged portion of the well bore is filled with said hardenable cementitious material;

(e) moving said valve of said tool back to said first position while said cementitious material is allowed to harden; and (f) drilling the well bore through said hardened cementitious material.

11. The method of claim 10 wherein said valve of said tool is a valve sleeve slidably disposed in said fluid flow passage of said tool which is movable between said first and second positions.

12. The method of claim 11 wherein said valve sleeve is moved back to said first position in accordance with step (e) by retrieving said activator plug from said tool and drill string whereby said valve sleeve is pulled from said second position to said first position prior to when said activator plug disengages from said valve sleeve.

13. The method of claim 11 wherein said valve sleeve is moved from said first position to said second position in accordance with step (c) by flowing an activator plug through the drill string into said tool and into releasable engagement with said valve sleeve whereby said activator plug and valve sleeve are moved by fluid pressure to said second position.

14. A method of stabilizing an unstable subterranean zone or formation penetrated by a well bore during the drilling of the well bore with a drill bit connected to a drill string comprising the steps of:

(a) placing a well stabilization tool in the drill string adjacent to the drill bit, said tool comprising:

a tubular housing having a longitudinal fluid flow passage extending therethrough, having one or more outwardly extending enlarged portions formed thereon whereby the outer surfaces of said enlarged portions are positioned in close proximity to the walls of the well bore drilled with the drill string and drill bit and having one or more lateral fluid jet forming ports extending from said fluid flow passage through said enlarged portions of said housing to the exteriors thereof, and a valve sleeve releasably and slidably disposed within said fluid flow passage of said housing and being movable between a first position whereby said fluid jet forming ports are closed by said valve sleeve and fluid pumped through the drill string is free to flow through said housing by way of the interior of said valve sleeve and a second position whereby said fluid jet forming ports are opened;

(b) drilling the well bore with said valve sleeve of said tool in said first position while pumping drilling fluid through the drill string and drill bit until the well bore has been drilled through the unstable subterranean zone or formation;

(c) flowing an activator plug with drilling fluid through the drill string and tool housing into releasable engagement with said valve sleeve whereby said activator plug and valve sleeve are moved by drilling fluid pressure to said second position and drilling fluid is flowed through said lateral fluid jet forming ports;

(d) pumping drilling fluid through said jet forming ports at a rate while moving said tool through the portion of the well bore in the unstable zone or formation whereby the diameter of that portion of the well bore is enlarged by jet erosion;

(e) pumping a hardenable cementitious material through the drill string and through said jet forming ports at a rate while moving said tool through the enlarged portion of the well bore in the unstable zone or formation whereby the enlarged portion of the well bore is filled with said hardenable cementitious material;

(f) retrieving said activator plug from said tool housing and from the drill string while said cementitious material is allowed to harden whereby said valve sleeve is pulled from said second position to said first position prior to when said activator plug is released and disengaged from said valve sleeve; and (g) drilling the well bore through said hardened cementitious material while pumping drilling fluid through the drill string and drill bit.

15. The method of claim 14 wherein said valve sleeve of said well stabilization tool is prevented from moving past said second position by an annular shoulder extending into said fluid flow passage of said housing.

16. The method of claim 15 wherein said valve sleeve of said well stabilization tool is releasably retained in said first position by a radially outwardly extending collet connected to said valve sleeve which engages a groove in said housing.

17. The method of claim 16 wherein said valve sleeve of said well stabilization tool is releasably engaged with said activator plug by said collet which is forced inwardly by the surfaces of said housing fluid flow passage into engagement with a groove in said activator plug when said valve sleeve is moved from said first position to said second position by said activator plug.

18. The method of claim 17 wherein said enlarged portions of said tubular housing of said well stabilization tool are comprised of two or more outwardly extending ribs formed thereon.

19. The method of claim 18 wherein said enlarged portions of said housing are comprised of three or four equally spaced outwardly extending longitudinal ribs.

20. The method of claim 19 wherein said housing includes three or more lateral fluid jet forming ports.

21. The method of claim 20 wherein said housing includes six or more lateral fluid jet forming ports.

22. The method of claim 17 which further comprises the step of moving the drill string and drill bit to a position in the well bore above said enlarged portion of the well bore filled with hardenable cementitious material after step (e) and prior to step (f).

23. The method of claim 22 wherein said activator plug includes a fishing neck and is retrieved by a fishing tool.

24. The method of claim 23 wherein said fishing tool is suspended within the drill string by a wire line, a slick line or a work string.

25. A well stabilization tool for enlarging and placing a hardenable cementitious material in an unstable subterranean zone or formation passed through by a well bore adapted to be connected to a drill string in place of the drill bit used to drill the well bore comprising:

a tubular housing having a longitudinal fluid flow passage extending therethrough, having a threaded drill string connection at the upper end thereof, having a plurality of lateral openings extending from said fluid flow passage to the exterior of said housing and having an annular shoulder extending into said flow passage below said lateral openings for receiving an activating plug; and a plurality of tubular arm members connected within said lateral openings in said housing having fluid flow passages therethrough and having fluid jet forming ports communicated with said fluid flow passages at the exterior ends thereof, said arm members being of lengths such that said fluid jet forming ports at the exterior ends thereof are positioned in close proximity to the walls of the well bore when said tool is connected to the drill string and placed in the well bore.

26. The well stabilization tool of claim 25 wherein said tubular arm members are threadedly connected within said lateral openings of said housing of said tool and are present in a number less than the number of openings in said housing, and said tool further comprises one or more plugs which are threadedly connected within the openings that do not have arm members connected therein.

27. The well stabilization tool of claim 25 which further comprises a well bore centralizer connected in the drill string near said tool.

28. The well stabilization tool of claim 25 wherein said housing of said tool includes seven of said lateral openings therein, four of said openings being equally spaced around the periphery of said housing in a first position on said housing and three of said openings being equally spaced around the periphery of said housing in a second position on said housing.

29. The well stabilization tool of claim 28 wherein seven of said tubular arm members are threadedly connected in said lateral openings.

30. The well stabilization tool of claim 28 wherein four of said tubular arm members are threadedly connected in said four openings in said first position on said housing, and said tool further comprises three plugs threadedly connected in said three openings in said second position.

31. The well stabilization tool of claim 28 wherein three of said tubular arm members are threadedly connected in said three openings in said second position, and said tool further comprises four plugs threadedly connected in said four openings in said first position.

32. A method of stabilizing an unstable subterranean zone or formation passed through by a well bore during the drilling of the well bore with a drill bit connected to a drill string comprising:

(a) removing the drill string and drill bit from the well bore;

(b) connecting a well stabilization tool to the drill string in place of the drill bit, said well stabilization tool comprising:

a tubular housing having a longitudinal fluid flow passage extending therethrough, having a threaded drill string connection at the upper end thereof, having a plurality of lateral openings extending from said fluid flow passage to the exterior of said housing and having an annular seat extending into said flow passage below said lateral openings for receiving an activator plug, and a plurality of tubular arm members connected within said openings in said housing having fluid flow passages therethrough and having fluid jet forming ports communicated with said fluid flow passages at the exterior ends thereof, said arm members being of lengths such that said fluid jet forming ports at the exterior ends thereof are positioned in close proximity to the walls of the well bore when said tool is connected to the drill string and placed in the well bore;

(c) placing the drill string and well stabilization tool in the well bore with said tool positioned within the portion of the well bore in the unstable zone or formation;

(d) flowing an activator plug with fluid pumped through the drill string into said housing of said tool whereby said activator plug lands on said annular seat in said housing and said fluid is caused to flow through said tubular arm members of said tool and said fluid jet forming ports thereof;

(e) pumping fluid through said fluid jet forming ports at a rate while moving said tool through the portion of the well bore in the unstable zone or formation whereby the diameter of that portion of the well bore is enlarged by fluid jet erosion;

(f) pumping a hardenable cementitious material through the drill string and through said fluid jet forming ports at a rate while moving said tool through the enlarged portion of the well bore in the unstable zone or formation whereby the enlarged portion of the well bore is filled with said hardenable cementitious material;

(g) removing the drill string and well stabilization tool from the well bore while said cementitious material is allowed to harden;

(h) reconnecting a drill bit to the drill string and placing the drill string and drill bit in the well bore; and (i) drilling the well bore through said hardened cementitious material.

33. The method of claim 32 which further comprises the step of:

prior to connecting said well stabilization tool to the drill string in accordance with step (b), adjusting the lengths of said tubular arm members connected to said housing of said tool as necessary to position the fluid jet forming ports at the exterior ends thereof in close proximity to the walls of the well bore when said tool is placed therein.

34. The method of claim 32 wherein said tubular arm members are threadedly connected within said openings of said housing of said tool and are present in a number less than the number of openings in said housing, and said tool further comprises one or more plugs threadedly connected within the openings which do not have arm members connected therein.

35. The method of claim 32 which further comprises the step of connecting a drill string centralizer in the drill string near said well stabilizer tool connected to the drill string in accordance with step (b).

36. The method of claim 32 wherein said housing of said tool includes seven of said lateral openings therein, four of said openings being equally spaced around the periphery of said housing in a first position on said housing and three of said openings being equally spaced around the periphery of said housing in a second position on said housing.

37. The method of claim 36 wherein seven of said tubular arm members are threadedly connected in said openings.

38. The method of claim 36 wherein four of said tubular arm members are threadedly connected in said four openings in said first position on said housing, and said tool further comprises three plugs threadedly connected in said three openings in said second position.

39. The method of claim 36 wherein three of said tubular arm members are threadedly connected in said three openings in said second position, and said tool further comprises four plugs threadedly connected in said four openings in said first position.

40. The method of claim 36 wherein two of said tubular arm members are threadedly connected in two opposite of said four openings in said first position on said housing, and said tool further comprises two plugs threadedly connected in two opposite of said four openings in said first position and three plugs threadedly connected in said three openings in said second position.

* * * * *